United States Patent [19]

Reich

[11] Patent Number: 4,682,377

[45] Date of Patent: Jul. 28, 1987

[54] DEVICE FOR TRANSFERRING IMMOBILE PERSONS

[75] Inventor: Peter S. Reich, Brooklyn, N.Y.

[73] Assignee: Design Mobility, Inc., Brooklyn, N.Y.

[21] Appl. No.: 879,256

[22] Filed: Jun. 27, 1986

[51] Int. Cl.[4] ..... A61G 7/08; A61G 7/10

[52] U.S. Cl. ..... 5/86; 5/81 R

[58] Field of Search ..... 5/81 R, 81 B, 83, 86, 5/87, 89

[56] References Cited

U.S. PATENT DOCUMENTS

| | | | |
|---|---|---|---|
| 2,792,052 | 5/1957 | Johannesen | 5/86 X |
| 3,694,829 | 10/1972 | Bakker | 5/81 R |
| 3,711,877 | 1/1973 | Averill | 5/81 R |
| 3,877,421 | 4/1975 | Brown | 5/81 B X |
| 3,940,808 | 3/1976 | Petrini | 5/86 |
| 4,028,752 | 6/1977 | Oerthel | 5/86 X |
| 4,070,721 | 1/1978 | Stasko | 5/86 X |
| 4,157,593 | 6/1979 | Kristensson | 5/81 R |
| 4,435,863 | 3/1984 | Lerich | 5/81 B |
| 4,545,085 | 10/1985 | Feldt | 5/81 R |
| 4,569,094 | 2/1986 | Hart et al. | 5/81 R |

FOREIGN PATENT DOCUMENTS

| | | | |
|---|---|---|---|
| 218600 | 3/1958 | Australia | 5/86 |
| 28525 | 12/1956 | Finland | 5/86 |
| 2414909 | 9/1979 | France | 5/81 R |

*Primary Examiner*—Gary L. Smith
*Assistant Examiner*—Carl M. DeFranco, Jr.
*Attorney, Agent, or Firm*—Kane, Dalsimer, Kane, Sullivan & Kurucz

[57] ABSTRACT

A device for lifting or lowering an invalid patient for movement between wheelchairs and/or beds, chairs, commodes and automobiles is disclosed which has a base, an upright, and a patient support member pivotably secured to the upright. A pivoting element pivots the support member for raising or lowering the patient. There is also provided a generally vertical plate for securing the patient's knees.

5 Claims, 4 Drawing Figures

DEVICE FOR TRANSFERRING IMMOBILE PERSONS

BACKGROUND OF THE INVENTION

Field of the Invention

This invention pertains to a device for lifting and transferring an immobile person between supports such as beds, wheelchairs, automobiles, and so on.

Background of the Invention

Traditionally immobile persons could be transferred from a wheelchair to a bed and back, from a wheelchair to a regular chair, or between any other similar support means only by being lifted by one or two people. Obviously this was unsatisfactory because it was uncomfortable and hard for the immobile person as well as the carriers. Devices have been made which can be used by one operator for lifting and transferring an immobile person, however until now all such devices were inefficient, bulky, uncomfortable and/or expensive. For example ITEC Company of Garden Grove, Calif. makes a hoist riding on a track with decline motors and a remote control unit. The system is very expensive, and can be used to transfer a person only to and from locations covered by the tracks. A number of portable lifters are available from the TRANS-AID Corporation of Carson, Calif., under the names of LIFT-AID or TRANS-AID, and from Hoyer, Ill. These devices include an overhead coat-hanger type mechanism from which slings are suspended to lift the immobile person, which is very cumbersome. MECHANAIDS of Burbank, Calif. also markets several lifting devices having the same base with wheels for mobility, an upright post, and a single cantilevered arm disposed on the part which may be raised and lowered either by a worm-gear mechanism, or a hydraulic cylinder. Small portable and car-loading versions of these lifts have the sling attached to the cantilevered arm at the level of the immobile person's face or chest so that it is extremely uncomfortable and potentially dangerous.

OBJECTIVES AND SUMMARY OF THE INVENTION

A principal objective of the present invention is to provide a mechanism which can be used to lift and transfer an immobile person easily, efficiently and economically.

Another objective is to provide a device which operates securely and safely, anchors the person's body to prevent undesirable rotations thereof, and maintains the person between normal seated and standing position.

A further objective is to provide a device which is as compact as possible, for use in small living quarters, and for transfer to an automobile seat. The device is portable and is collapsible for storage without disassembly and with all parts remaining attached (except slings).

Other objectives and advantages of the invention shall become apparent from the following description of the invention. In accordance with this invention a device for transferring an immobile person comprises a base, an upright secured to the base, a y-shaped member rotatably secured at one end to the top of the upright. The free ends of the member hold a sling for supporting and lifting the person. There are also provided lifting means for lifting the person by rotating the y-shaped member upward with respect to the upright, and a plate disposed on the base and positioned to brace the person's knees during lifting or lowering operation. The plate may be shifted vertically.

DETAILED DESCRIPTION OF THE INVENTION

Figure 1:
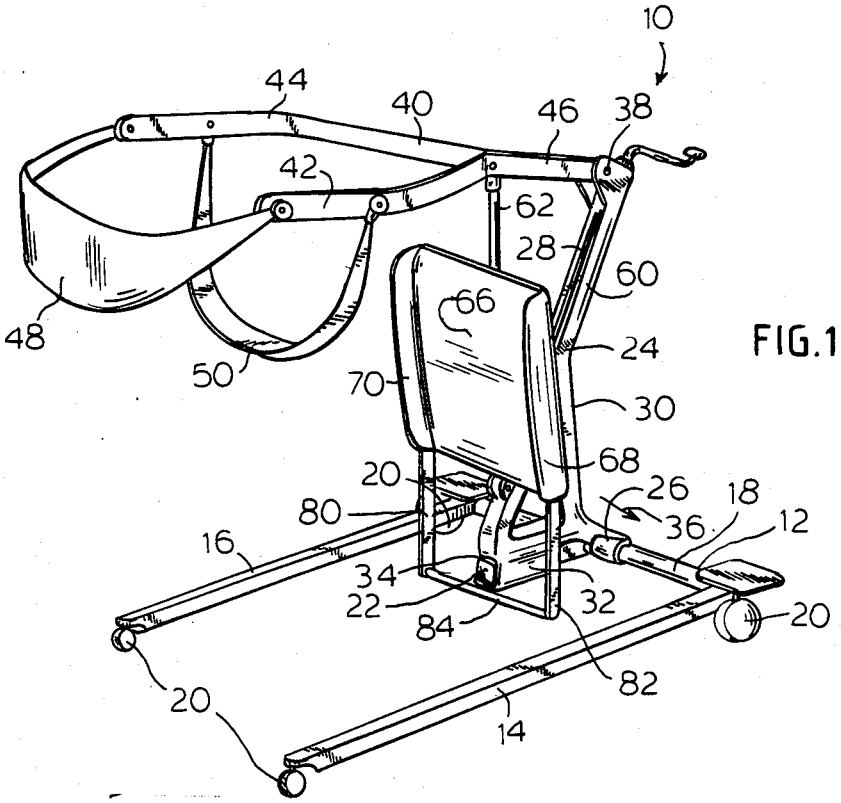
FIG. 1 shows a perspective view of a preferred embodiment of the present invention.

Referring now to the Figures, and more particularly to FIG. 1, a device 10 for lifting invalids comprises a U-shaped base 12 with two parallel arms 14, 16 and joined by a base member 18. The base is provided with casters 20 at its four corners. Affixed to base member 18 there is a square extension 22 disposed in parallel with and about half-way between arms 14 and 16.

The device also has an upright member 24. At the lower end of member 24, there is circular sleeve 26 slidably mounted on base member 18. The upright also has a longitudinal member 28 which is hollow, a vertical member 30 extending between the longitudinal member 28 and sleeve 26, and a horizontal member 32 extending between the respective lower ends of members 28 and 30. The horizontal member is generally C-shaped with a side opening 34 for capturing base extension 22.

Upright 24 is thus shiftable in a horizontal direction along base member 18, and it has one extreme horizontal position shown in FIG. 1 wherein the base extension 22 is captured by the horizontal member 32, thereby preventing the rotation of upright 24 with respect to base 12. If the upright 24 is shifted along member 18 in the direction of arrow 36 until extension 34 is disengaged from member 32, then the upright becomes freely rotatable with respect to the base 12.

At its upper end, upright 24 is pivotably connected at pivot point 38 to a y-shaped member 40. This member 40 has two arms 42, 44 joined in a common leg 46.

Attached between the extreme ends of arms 42, 44 there is a semi-rigid flexible sling 48. A second sling 50 may be attached at a point spaced away from the arm ends as shown. These slings are made of woven fabrics or other web-like materials and may be removed to use the device, and for cleaning or storage purposes.

Inside longitudinal member 28 there is a lead screw 52 which may be turned by a crank 54. Alternatively the lead screw may be coupled to an electric motor (not shown). On the lead screw there is a ball nut 56 with a member 58. Member 58 extends through a slot 60 in the longitudinal member 28. A rod 62 extends between member 58 and leg 46 and is pivotably attached thereto at both ends. A socket 64 is pivotally attached to leg 46 and is normally pointing downward to receive an upper end of rod 62. Lifting leg 46 automatically disengages it from the rod 62. A generally rectangular plate 66 is secured to the rod and is arranged in a generally vertical position as shown. Preferably the plate is provided with two side walls 68, 70 extending away from upright 24.

Two uprights 80, 82 extend downwardly from plate 60 and support a rod bar 84.

Figure 2:
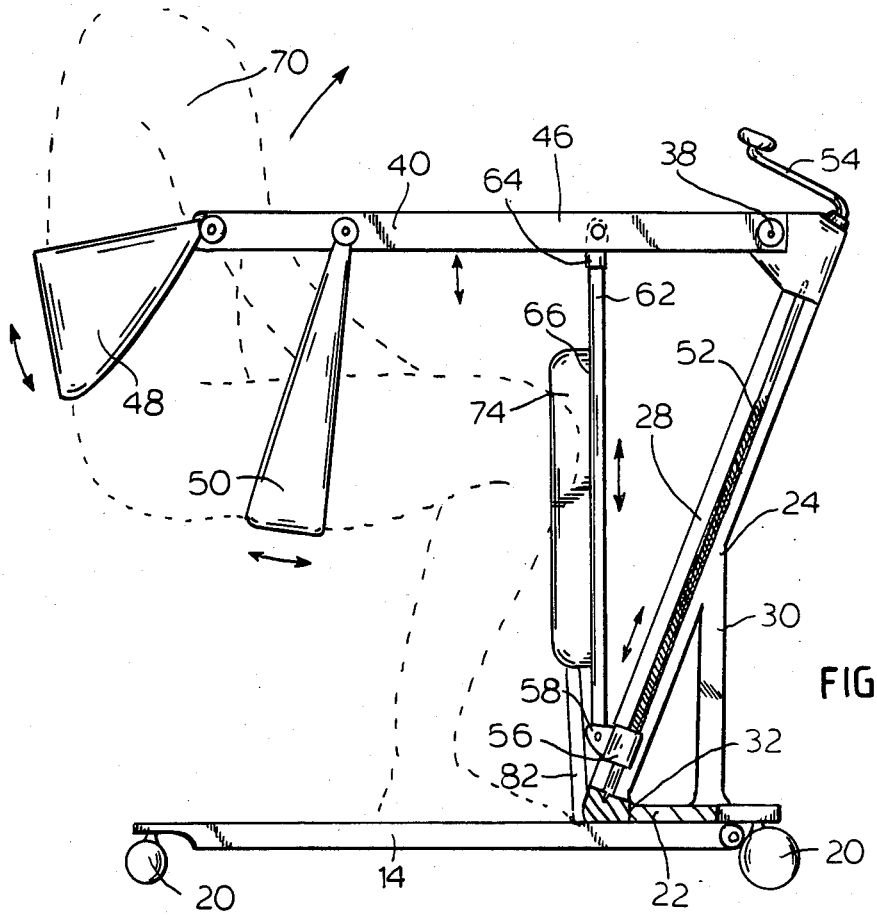
FIG. 2 shows a side view of the device of FIG. 1, in a lower position.
Figure 3:
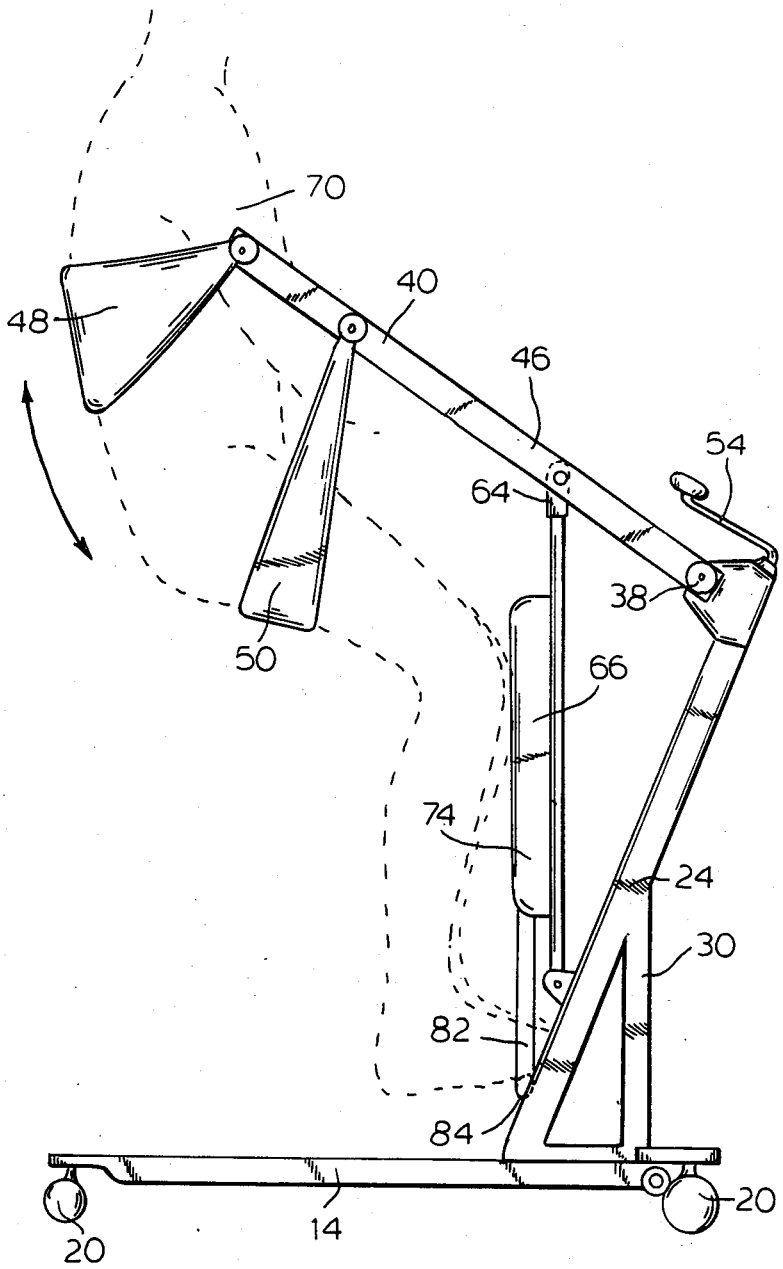
FIG. 3 shows the device of FIG. 2 in an upward position.

The device operates as follows. It is first positioned in a faced relationship with a patient 70 (FIG. 2) sitting on a support 72 (i.e. a bed, a wheelchair, etc.), with the patient's knees 74 resting against plate 66 and his feet resting on the bar 84 attached to 66. The sling 48 is then placed around the back of the patient and under his armpits and then attached to arms 42, 44. For a partially incapacitated patient this sling may be sufficient. For a completely immobile patient, the second sling 50 may have to be used for support under the thighs as shown in FIG. 2, and would be inserted first. The patient is then lifted towards an upward or quasi-standing position by turning crank 54. The crank forces the ball nut 56 to move upward thereby pivoting the y-shaped member 40 around pivot point 38. The device and patient are shown in the standing position in FIG. 3. In this position the patient may be easily shifted to another support and may be transported for short distances.

Importantly, while the patient is held by the device, his knees are supported and in effect trapped by the plate 66 and its side walls 68, 70 so that the patient's body does not swing, thereby giving the patient a sense of security. Also, the arms 42 and 44 are to either side of the patient's chest and face, should he begin to slump forward, he will not contact them. Since the plate 66 is attached to the rod 62, this plate moves upward with the patient. The patient is lowered to the initial position of FIG. 2 by turning the crank in the opposition direction. Obviously the crank could be replaced by an electric motor as previously mentioned.

Figure 4:
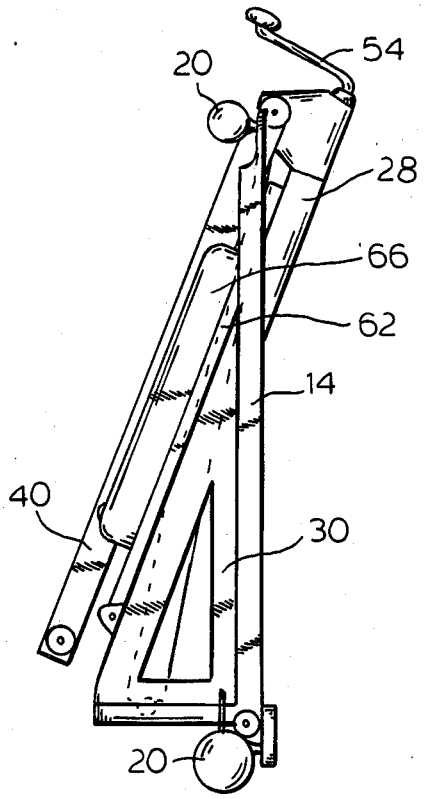
FIG. 4 shows a side view of the device of FIG. 1 after it has been folded.

After the patient has been transferred, the device of FIG. 1 may be easily folded by shifting the upright 24 sideways until the base extension 22 is disengaged. The base 12 is then rotated around member 18 until legs 14, 16 extend generally vertically in parallel with member 30 as shown in FIG. 4. Furthermore, rod 62 is removed from socket 64, allowing the rod 62 and plate 66 to pivot to a position generally parallel to member 28. At the same time, the y-shaped member 40 is no longer held in a horizontal position by rod 62 and therefore it may drop as shown in FIG. 4. Thus the whole device folds easily into a compact package for storage and transportation.

I claim:

1. A device for lifting and lowering invalid patients and for transferring them from one location to another comprising:

a base supported on roller means so as to be readily movable from one location to another;

an upright member mounted on and extending upwardly from said base;

a lever arm connected at one end adjacent the upper portion of the upright member by means of a horizontal pivot so as to be rotatably shiftable in a vertical plane only and terminating at its outer end in a pair of horizontally spaced end portions, said end portions normally being spaced outwardly from the upright member in a generally horizontal direction;

means for attaching a sling between the said end portions by engagement around the back of a patient at a location beneath his armpits;

lifting and lowering mechanism associated with the said upright member;

a drive rod having pivotal connection at its upper end to the lever arm at a point intermediate the length thereof and extending downwardly therefrom into connection with the lifting and lowering mechanism; and a knee and leg engaging plate member mounted on the drive rod intermediate the length thereof in facing relation to the end portions of the lever arm whereby when a sling attached to said end portions is engaged around the back of a seated patient at a point beneath the level of his armpits and the lifting and lowering mechanism is actuated to lift the patient, the patient is moved above seated position and is held against rotation so that he can be transferred from one location to another.

2. A device for lifting and lowering invalid patients and for transferring them from one location to another as set forth in claim 1 in which means are provided for supporting the feet of patients beneath and attached to the knee and leg engaging plate.

3. A device for lifting and lowering invalid patients and for transferring them from one location to another as set forth in claim 1 in which the knee and leg engaging plate moves in an upward direction when the lifting and lowering mechanism is actuated to lift the patient at a rate of speed lower than that at which the sling moves due to the leveraged arrangement of the lever arm to thereby aid in raising the patient from seated position.

4. A device for lifting and lowering invalid patients and for transferring them from one location to another as set forth in claim 1 in which means are provided on the horizontally spaced end portions of the lever arm at a spaced distance from their outer end for attaching a second sling to engage the under portion of the thighs of a patient.

5. A device for lifting and lowering invalid patients and for transferring them from one location to another as set forth in claim 1 in which the base has a transverse supporting rod having a stop lug fixedly mounted at an intermediate portion thereof and the upright member is pivotally mounted on said supporting rod and shiftable into and out of engagement with the stop lug so that when in engagement with the lug it is fixedly held in upright position and when shifted out of engagement with the lug can be folded downwardly into engagement with the base and the drive rod is releasably connected to the lever arm so that when the connection is released the lever arm and rod can in turn be folded parallel to the upright member.

* * * * *